US006497129B2

(12) United States Patent
Pfeiffer et al.

(10) Patent No.: US 6,497,129 B2
(45) Date of Patent: Dec. 24, 2002

(54) METHOD FOR ROLLING TUBE BLANKS IN A PLANETARY SKEW ROLLING MILL

(75) Inventors: Thomas Pfeiffer, Grevenbroich (DE); Horst Franken, Mönchengladbach (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/880,362

(22) Filed: Jun. 13, 2001

(65) Prior Publication Data

US 2002/0020201 A1 Feb. 21, 2002

(30) Foreign Application Priority Data

Jun. 14, 2000 (DE) ..... 100 29 114
May 22, 2001 (DE) ..... 101 26 411

(51) Int. Cl.[7] ..... B21D 3/00

(52) U.S. Cl. ..... 72/78; 72/96; 72/250; 72/366.2

(58) Field of Search ..... 72/78, 95, 96, 72/97, 98, 99, 209, 366.2, 370.01, 250, 252

(56) References Cited

U.S. PATENT DOCUMENTS 3,717,018 A * 2/1973 Bellman et al. ..... 72/97
4,501,134 A * 2/1985 Staat et al. ..... 72/78
4,738,128 A * 4/1988 Staat ..... 72/96

FOREIGN PATENT DOCUMENTS

DE 3905559 * 8/1990 ..... 72/78

* cited by examiner

*Primary Examiner*—Ed Tolan
(74) *Attorney, Agent, or Firm*—Cohen, Pontani, Lieberman & Pavane

(57) ABSTRACT

A method and device for rolling tube blanks in a planetary skew rolling mill continuously feeds tubular blanks which are to be rolled into the rolling gap end to end. A first tube blank is located in the rolling mill. A second tubular blank following the first tubular blank which is respectively located in the rolling gap of the rolling mill is fed forward with a rotation corresponding to the rotation of the end of the first tube blank caused by the torsion under the rollers in the rolling mill.

8 Claims, 1 Drawing Sheet

METHOD FOR ROLLING TUBE BLANKS IN A PLANETARY SKEW ROLLING MILL

BACKGROUND OF THE INVENTION

1. Field of the Invention

The present invention relates to a method for rolling tube blanks in a planetary skew rolling mill.

2. Description of the Related Art

In practice, tube blanks are loaded into planetary skew rolling mills discontinuously. Therefore, loading in a new tube blank inevitably leads to a downtime of the rolling mill which influences the overall performance of the rolling mill.

On the other hand, a continuous method of operating is known with cold pilger rolling. In this method, the blank to be cold pilger rolled is loaded without interrupting the rolling operation. The tube blank to be rolled is fed forward incrementally by driven feed carriages toward the rolling stand which moves backward and forward.

In addition, the tube blank is rotated incrementally during the forward feed by driven run-in and run-out chucks which are mounted upstream and downstream of the rolling stand.

German reference DE 33 04 002 C1 discloses a forward feed device for a cold pilger rolling mill having two feed carriages which are equipped with chucks. Each of these feed carriages is moved by two feed spindles arranged in parallel and on each side of the rolling line, via spindle nuts arranged in the feed carriage. This arrangement of the feed spindles permits a moment-free application of force to the feed carriages and continuous forward feeding of the blank, thereby allowing continuous rolling operation. German reference DE 29 22 941 C2 discloses a cold pilger rolling mill in which the first feed carriage is provided with a device for gripping the end of the blank during forward feeding. A device for pulling back the blank counter to the forward feed direction behind the mandrel stop assigned to the first speed-changing gear mechanism is assigned to the second feed carriage. The feed travel of the second feed carriage is dimensioned such that the front end of the blank being fed forward by the second feed carriage lies between the rolling stand and the driver device of the first feed carriage. This design and arrangement also permits continuous forward feed of the tube blanks to be rolled.

Cold pilger rolling requires both positive forward feed in the axial direction and positive rotation of the tube blank so that uniform rolling occurs over the circumference of the tube as a result of the conically profiled rollers in the rolling stand which moves backward and forward.

Skew rolling is different in that the roller arrangement of a skew rolling mill includes conical rollers arranged in a rotor which circulates about the tubular blank. The conical rollers arc rotated by the rotor in a rolling stand in the manner of a planet and thereby continuously draw the tubular blank into the rolling stand. Feed carriages are actually necessary only for rolling the blank head onto the roll stand. However, they may be optionally connected into the system during ongoing operation.

A further feature of skew rolling mills is that both the blank and the tube turn slowly as a result of torsion of the material during rolling. Both the direction of rotation and the angular speed are undeterminable before the rolling operation. The tube which is running out of the skew rolling mill may be required to be wound up behind the rolling stand. To allow for this, the tube must be prevented from rotating as it exits the rolling stand. This is achieved by varying the rotational speeds of the rotor and of the rollers with respect to one another. The rotor and the rollers are driven by separate motors in an arrangement referred to as a variable ratio planetary drive. A sensor, which detects rotation of the tube which is running out, is mounted on the runout side of the rolling mill. The rotation of the blank may be controlled such that the tube does not rotate only with an unacceptably high degree of expenditure on measurement and control. In this case, it would not be sufficient to change the rotational speed of the rotor and of the rollers with respect to one another but instead the position of the rollers would also have to be adapted to the tubular blank and to the tube. However, this can not be carried out with a running machine. For this reason, in most cases the tubular blank will rotate in an undetermined direction and with an undetermined angular speed.

SUMMARY OF THE INVENTION

The object of the present invention is to increase the performance of the planetary skew bevel gear rolling mill while taking into account the particular properties of this rolling method.

The object is achieved according to an embodiment of the present invention by continuously feeding the tube blanks which are to be rolled into a rolling gap of the roll stand end to end. A first tube blank is located in the rolling gap of the rolling stand. A second tubular blank directly following the first tubular blank is fed forward with a rotation corresponding to the rotation of the end of the first tubular blank caused by the torsion during rolling.

To this end, a device is provided for feeding tube blanks into a planetary skew rolling mill. A tubular blank may be rolled out by an internal tool which is fixedly held in position with respect to the rolling gap. The device includes a first holding device and a second holding device arranged at an axial distance from each other for holding a mandrel rod. Clamping jaws of the first and second holding devices may engage radially against the mandrel rod independently of one another. First and second forward feed devices for the tube blanks including clamping jaws are arranged for selectively engaging radially against the tube blanks independently of one another. Each of the first and second forward feed devices may be displaced with the tube blank in the forward feed direction or counter thereto. A device for pushing is arranged for pushing a new tubular blank onto the rear end of the mandrel rod which is held in the rolling position during the rolling of a preceding tubular blank. The movements of the holding devices and of the forward feed devices are capable of being matched to one another such that the rear end of the preceding tubular blank and the front end of the following tubular blank can be fed end to end to the rolling gap.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
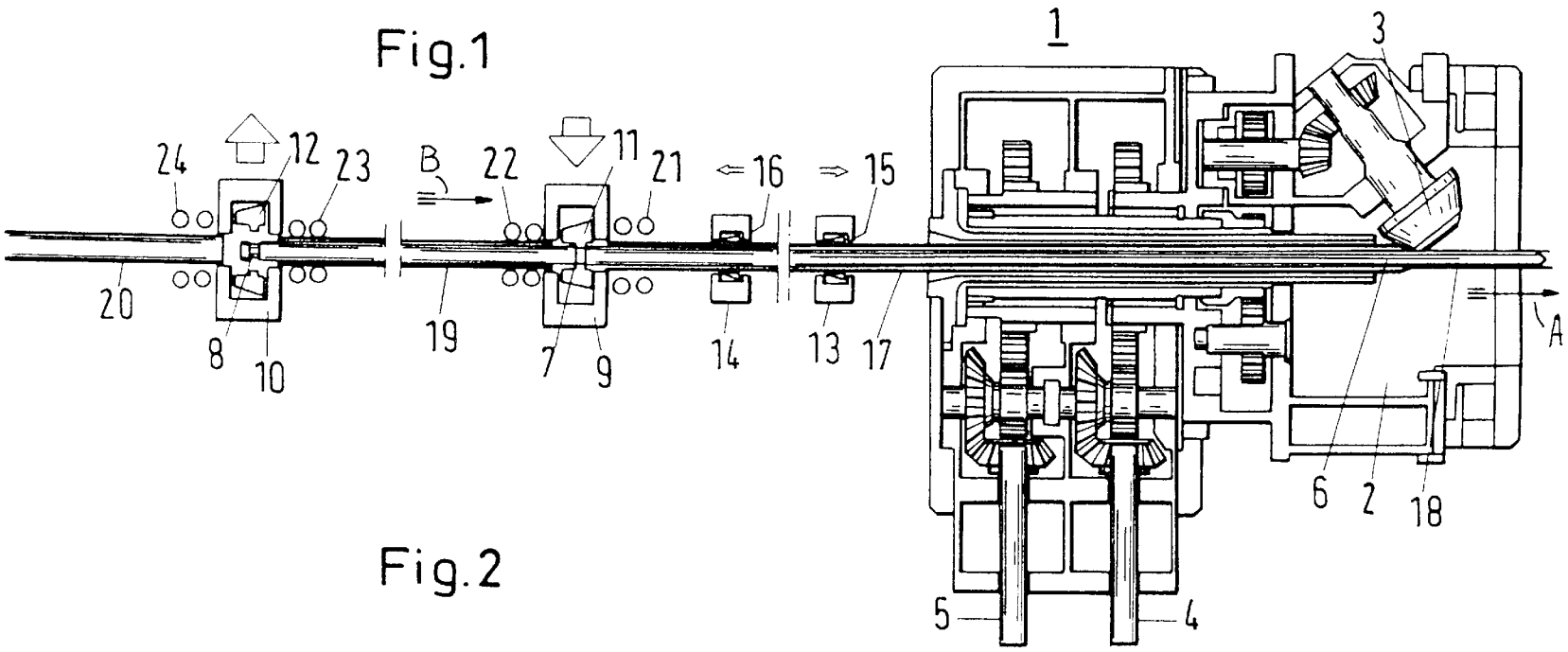
FIG. 1 is a schematic view of a system for feeding tube blanks to a skew rolling mill according to the present invention.

A device for feeding tube blanks to a skew rolling mill 1 according to the present invention is illustrated in FIG. 1. The planetary skew rolling mill 1 includes a rotor 2 and rollers 3 located therein (only one of the rollers 3 is illustrated). The rotor 2 is driven by a journal 4 and the rollers 3 are driven by another journal 5. Both journals 4, 5 are driven via motors (not shown) which together form a variable ratio planetary drive. By matching the rotational speeds of the motors it is possible to prevent a tube 18 which is running out of the rollers 3 from rotating.

An internal tool comprising a mandrel rod 6 is arranged in a rolling gap under the rollers 3. The mandrel rod 6 includes notches 7 and 8 which respectively lie in two holding devices 9 and 10. The holding devices 9, 10 are located in a fixed position. However, the locations of the holding devices 9, 10 may be adjusted in the axial direction of the mandrel rod 6. by an adjustment mechanism (not illustrated in itself which is actuated manually or by motor. Clamping jaws 11, 12 are arranged inside the holding devices 9, 10 which may be engaged by an electric motor or hydraulically. The clamping jaws 11, 12 clamp the mandrel rod 6 in the closed state and secure it against forces which occur axially and which originate from the rolling gap. The clamping jaws 11, 12 are mounted so as to be freely rotatable to avoid impeding the rotation of the mandrel rod 6 which originates from the rolling process. If the mandrel rod 6 were not free to rotate, the rolling process could be disrupted and give rise to faults on the tube 18.

Two forward feed devices 13 and 14, which can be moved backward and forward in the longitudinal direction of the mandrel rod 6 by, for example, hydraulic cylinders (not shown) are arranged between the planetary skew rolling mill 1 and the holding device 9. The hydraulic cylinders are pressure regulated to exert constant forward feed forces on a first tubular blank 17 while it is being rolled. The two forward feed devices 13, 14 are adjusted to the same speed by a synchronizing device (not shown) as the joint between tube blanks travels through to ensure precise forward feeding of the first tubular blank 17 and a second tube blank 19 which are laid end to end.

The forward feed devices 13, 14 are also respectively equipped with clamping Jaws 15 and 16 which can be engaged by motor and which alternately clamp the first tube blank 17 in position. These clamping jaws 15, 16 are also freely rotatably mounted because the first tubular blank 17 is also caused to undergo an undefined rotation by the rolling process, which rotation must not correspond to the rotational speed of the mandrel rod 6. In addition, the clamping jaws 15, 16 have a rotary drive (not shown) which can be connected into the system and which can cause the first tubular blank 17 to rotate in a selective fashion if this is required in the course of the rolling process. Alternatively, the clamping jaws 15, 16 may be opened during the rolling and not exert any forward feed force on the first tubular blank 17 by the hydraulic cylinders because the forward feeding may also be generated by the rolling process itself, which is possible in skew rolling processes.

The first tubular blank 17 extends through the entire skew rolling mill 1 and exits as a tube 18 behind the rollers 3, the rolling direction being illustrated by an arrow A. The second tubular blank 19 is located between the two holding devices 9, 10 and a third tubular blank 20 is in the ready position.

The tubular blanks are fed forward toward the skew rolling mill 1 by driving apparatuses 21, 22, 23 and 24.

The method of operation of the system is now described in the following. FIG. 1 shows the system at the beginning of the rolling process. The first tubular blank 17 is located with its head, i.e., the leading end, in the rolling gap between the rollers 3 and it leaves the planetary skew rolling mill 1 in the direction of the arrow A as a tube 18 while the rotor 2 rotates about the tube 18. The clamping jaws 11 of the holding device 9 are closed and hold the mandrel rod 6 tightly in a freely rotating fashion in the notch 7. The forward feed devices 13 and 14 feed the first tube blank 17 forward in hand-to-hand operation, the clamping jaws 15 and 16 being closed on the forward stroke and feeding the first tubular blank 17 forward in a freely rotating fashion and being opened, or at least switched to a pressureless state, on the return stroke. The driving apparatus 21 is in the opened position. The clamping jaws 12 of the holding device 10 are opened and the second tubular blank 19 has been pushed onto the rear end of the mandrel rod 6 in the direction of the arrow B by the driving apparatuses 22 and 23. The third tubular blank 20 is in the waiting position and is fed forward at the correct time by the driving apparatus 24.

Figure 2:
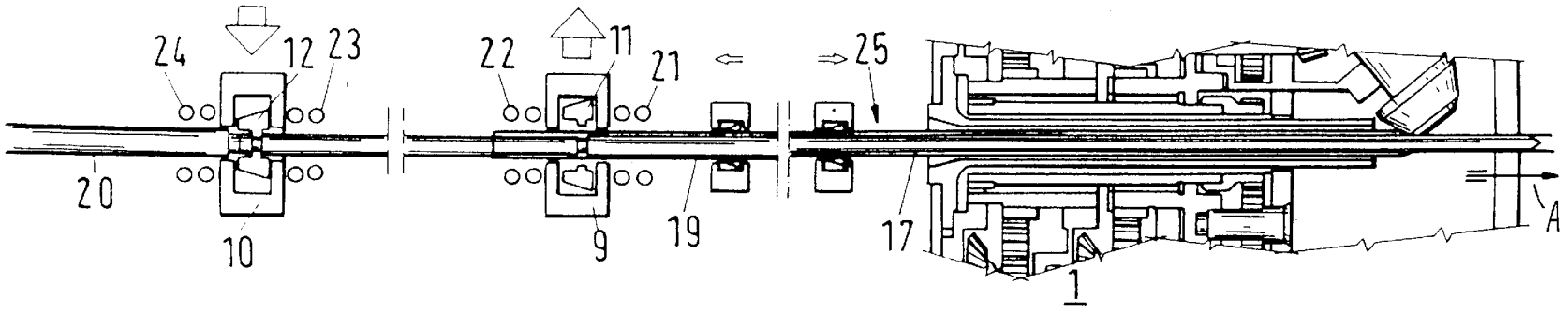
FIG. 2 is a schematic view of the system of FIG. 1 at a different operating state.

FIG. 2 shows the rolling process in a further advanced stage. A joint 25 between the first and second tubular blanks 17 and 19 is located just before the planetary skew rolling mill 1. That is, the first tubular blank 17 is fed forward by the second tubula r blank 19. The tubular blank 19 is located in the vicinity of the holding device 9 in FIG. 2. The clamping jaws 11 of holdings device 9 are opened and the clamping jaws 12 of the holding device 10 are closed. The second tubular blank 19 is fed forward by the forward feed devices 13 and 14 in the rolling direction and all the driving apparatuses 21 to 24 are in the opened position. When the second tubular blank 19 has passed the holding device 9, the clamping jaws 11 thereof close and the clamping jaws 12 of the holding device 10 open after a certain delay. The third tubular blank 20 is then pushed into the empty space between the holding devices 9 and 10, and a phase according to FIG. 1 starts again.

The sequence described above allows tubular blanks to be moved end to end through the planetary skew rolling mill without interrupting the rolling process. In this way, downtimes are avoided and the productivity of the rolling system is increased.

However, allowance is also made for the fact that the tubular blank continuously moves forward independently and in doing so also executes undefined rotations. If, as indicated in the solution according to the invention, the forward feed devices have freely rotatable clamping jaws, i.e. clamping jaws which can rotate coaxially along with the rotating tubular blank, a new tubular blank may be fed without interrupting the rolling process. To do this, all that is then necessary is to alternately open and close the clamping jaws—as is known from cold pilger rolling.

Instead of the freely rotatable clamping jaws, a freely rotatable plate which engages against the rear end of the following tubular blank may alternatively be provided. However, said plate must then have a central opening to permit a new blank to be pushed through the plate.

In a further refinement of the present invention, the tubular blank may be gripped with the clamping jaws and positively rotated and fed forward such that the rotational speed and forward feeding speed correspond approximately to the rotation and forward feeding speed which are exerted on the blank by the rolling stand.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A method for rolling tube blanks in a planetary skew rolling mill, comprising the steps of:

continuously feeding tube blanks to be rolled end to end into a rolling gap of the planetary skew rolling mill, a first tubular blank being located in the rolling gap and a second tubular blank following the first tubular blank, the first tubular blank being subjected to a torsion in the rolling gap causing a rotation of a trailing end thereof; and feeding the second tubular blank forward with a rotation corresponding to the rotation of the trailing end of the first tubular blank caused by the torsion.

2. The method of claim 1, further comprising the step of rotating the second tubular blank by frictional locking of the second tubular blank with the trailing end of the first tube blank.

3. The method of claim 1, wherein said step of feeding the second tubular blank forward comprises holding the second tubular blank so that it is freely rotatable during the forward feeding.

4. The method of claim 1, wherein said step of feeding the second tube blank comprises positively rotating and feeding the second tubular blank forward such that a rotation rate and forward feed rate of the second tubular tube blank correspond to the rotation and forward feed speed which are exerted by the rolling stand on the first tubular blank located in the rolling gap.

5. A device for feeding tubular blanks into a planetary skew rolling mill for forming a tube, the skew rolling mill having an internal tool including a mandrel rod via which the tube is rolled out of the the skew rolling mill, said device comprising:

first and second holding devices, wherein said second holding device is arranged at an axial distance from said first holding device and each of said first and second holding devices is independently selectively engageable radially against the mandrel rod;

first and second forward feed devices independently selectively engageable radially against a tubular blank to be fed and displaceable with the tubular blank to be fed in one of a feeding direction and a counter feeding direction; and a pushing device for pushing a new tubular blank onto a rear end of the mandrel rod, during a rolling of a preceding tubular blank in the skew rolling mill, wherein said first and second holding devices and said first and second forward feed devices are operatively arranged for feeding the preceding tubular blank which is in the rolling mill and the new tubular blank following the preceding tubular blank such that a front end of the new tubular blank is fed end to end with the rear end of the preceding tubular blank to the rolling gap in the skew rolling mill.

6. The device of claim 5, wherein each of said first and second forward feed devices comprises clamping jaws for holding a tubular blank therebetween, wherein said clamping jaws are mounted such that said clamping jaws are freely rotatable about a longitudinal axis of a tube blank arranged therebetween.

7. The device of claim 5, wherein said first and second holding devices for the mandrel rod are mounted such that said first and second holding devices are freely rotatable about a longitudinal axis of the mandrel rod.

8. The device of claim 6, wherein said clamping jaws of said first and second forward feed device are arranged such that they are drivable to rotate about the tube blank held therebetween.

* * * * *